US005340342A

United States Patent [19]

Boda et al.

[11] Patent Number: 5,340,342

[45] Date of Patent: Aug. 23, 1994

[54] UNIVERSAL TILLER HANDLE WITH SHIFT AND THROTTLE

[75] Inventors: James C. Boda, Winneconne; Kenneth G. Appleby, Van Dyne, both of

[73] Assignee: Brunswick Corporation, Lake Forest, Ill.

[21] Appl. No.: 71,232

[22] Filed: Jun. 2, 1993

[51] Int. Cl.[5] ..... B63H 21/21

[52] U.S. Cl. ..... 440/86; 440/87

[58] Field of Search ..... 440/84, 86, 87; 74/480 B, 107

[56] References Cited

U.S. PATENT DOCUMENTS

| | | | |
|---|---|---|---|
| 2,751,799 | 6/1956 | Long | 440/86 |
| 3,782,219 | 1/1974 | Beck et al. | 74/531 |
| 3,820,641 | 6/1974 | Borst et al. | 440/86 |
| 3,922,996 | 12/1975 | Meyer | 74/480 B X |
| 4,241,687 | 12/1980 | Du Bois et al. | 440/87 |
| 4,582,493 | 4/1986 | Toyohara et al. | 440/86 X |
| 4,650,429 | 3/1987 | Boda | 440/87 |

OTHER PUBLICATIONS

Mercury Marine Service Manual for 20–25 HP. Oct. '90 Edition, pp. 6–11.

OMC Service Manual, 45C/eng, pp. 5–5 through 5–9.

Archimedes/Penta 250, Monark/Crescent 25, Oct. 1971, pp. 26–29.

*Primary Examiner*—Sherman Basinger

*Attorney, Agent, or Firm*—Andrus, Sceales, Starke & Sawall

[57] ABSTRACT

A tiller handle is provided for use with one or more push-pull cables innerconnected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

27 Claims, 5 Drawing Sheets

FIG. 1
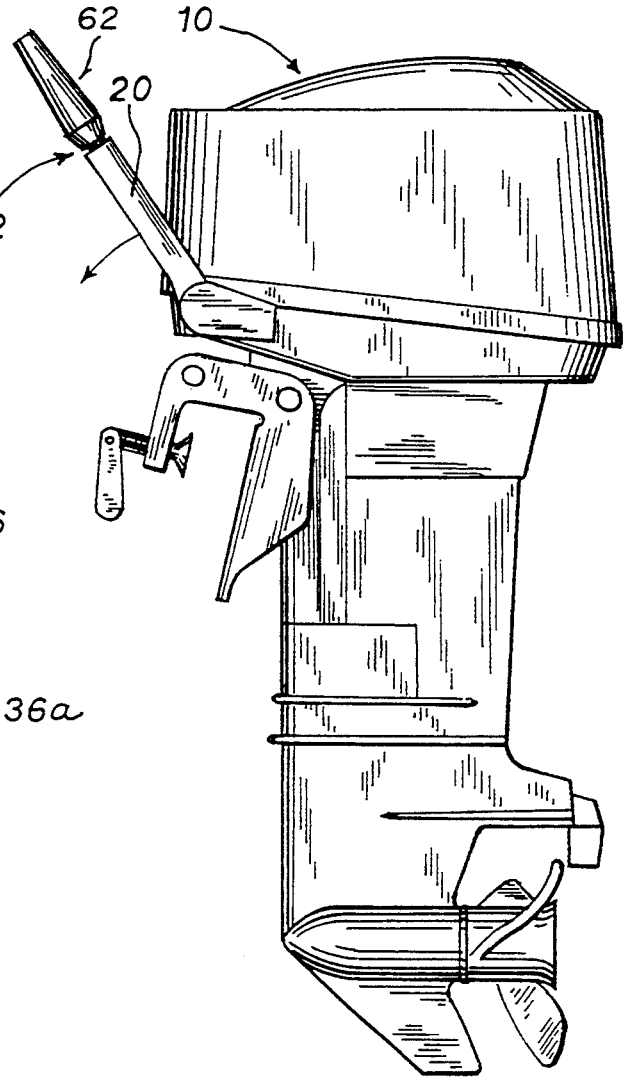
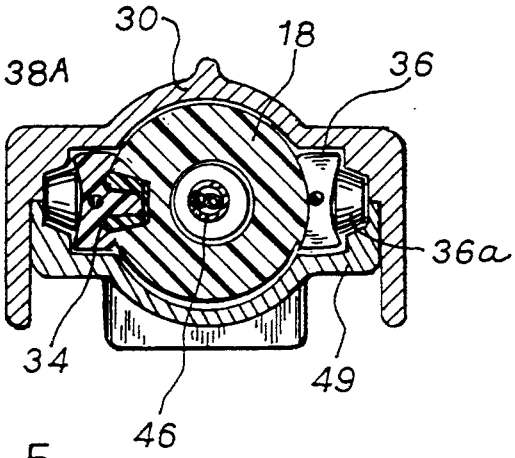
FIG. 5
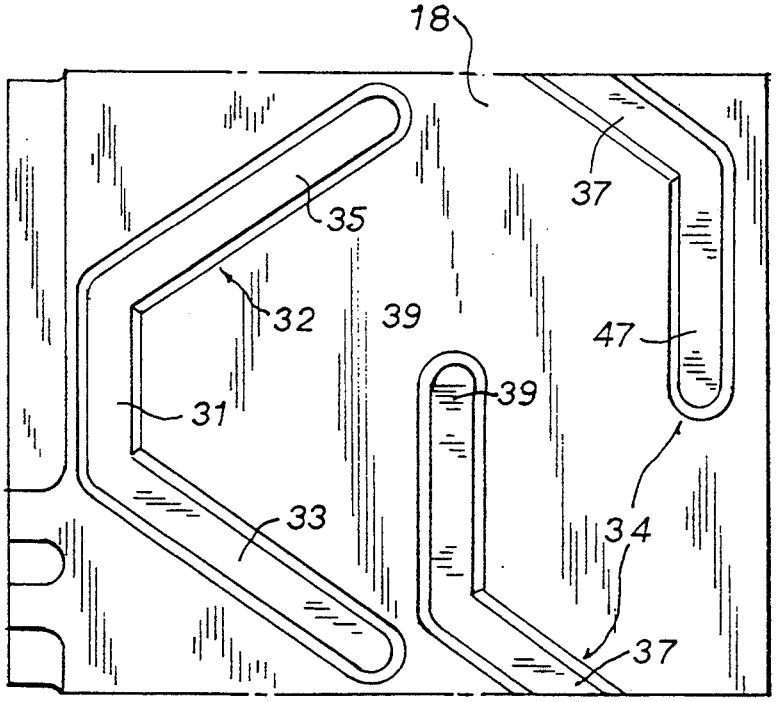
FIG. 8

UNIVERSAL TILLER HANDLE WITH SHIFT AND THROTTLE

BACKGROUND AND SUMMARY OF THE INVENTION

This invention relates to a tiller handle for an outboard marine propulsion system and, more particularly, to the control of the shift and the throttle operations of an outboard motor.

Tiller handles have long been used to control the shift and the throttle operations of outboard marine engines. The prior art shows tiller handles wherein the throttle and shift linkage is comprised of numerous component parts. The numerous component parts lead to difficulties in assembly which increase the manufacturing costs of the engine. It is therefore desirable to develop a less complicated alternative to the throttle and shift linkage presently known.

Previous attempts to simplify tiller handle construction and operation have lead to the development of a tiller handle which utilizes a push-pull cable to control the throttle operation of an outboard marine engine. The push-pull cable slidably engages the inner surface of a rotatable, tubular member within the handle. This design has an inherent problem in that the tiller handle can only control a single function of the outboard marine engine.

It is therefore a primary objective of this invention to provide a less complex tiller handle for controlling the shift and the throttle operations of an outboard marine engine.

It is a further objective to provide a tiller handle which uses a plurality of push-pull cables to control the shift and the throttle operations of an outboard marine engine.

In accordance with the invention, a tiller handle is provided for use with push-pull cables which control the shift and the throttle operations of an outboard marine propulsion system. The tiller handle includes a housing pivotally mounted to the outboard marine propulsion system. A rotatable cam is maintained within the housing by means of a stationary cam cover. On the outer surface of the cam is a plurality of distinct cam tracks. Each track controls the position of one of the push-pull cables, which in turn controls a single operation of the outboard marine engine. Each push-pull cable is maintained within the distinct cam track by means of a bearing which slidably engages the track.

By rotating the cam in response to manual rotation of the tiller handle, each push-pull cable is actuated by movement of the bearings within the cam tracks, thereby controlling the corresponding operation of the outboard marine engine.

A drive tube extends through the housing, and is interconnected with the rotatable cam such that the rotation of the drive tube in turn rotates the cam and actuates the push-pull cables. A limiter prevents the unlimited rotation of the drive tube so as to maintain operation of the outboard marine engine within predetermined limits.

BRIEF DESCRIPTION OF THE DRAWINGS

The drawings illustrate the best mode presently contemplated for carrying out the invention.

FIG. 1 is a view of an outboard marine propulsion system incorporating the tiller handle of the invention.

FIG. 5 is a sectional view of the tiller handle of the invention taken along line 5—5 of FIG. 3.

FIG. 8 is a plan view of the surface of the cam, which forms a part of the tiller handle of the invention, showing the layout of the shift and throttle cam tracks.

DETAILED DESCRIPTION OF THE PREFERRED EMBODIMENT

As shown in FIG. 1, a marine outboard propulsion system is generally designated at 10. The tiller handle to which this invention relates is generally designated at 12. As is known, tiller handle 12 is used by an operator to provide steering of the boat to which marine propulsion system 10 is mounted. In accordance with the invention, tiller handle 12 is also used to control the shift and the throttle functions of marine propulsion system 10.

Figure 4:
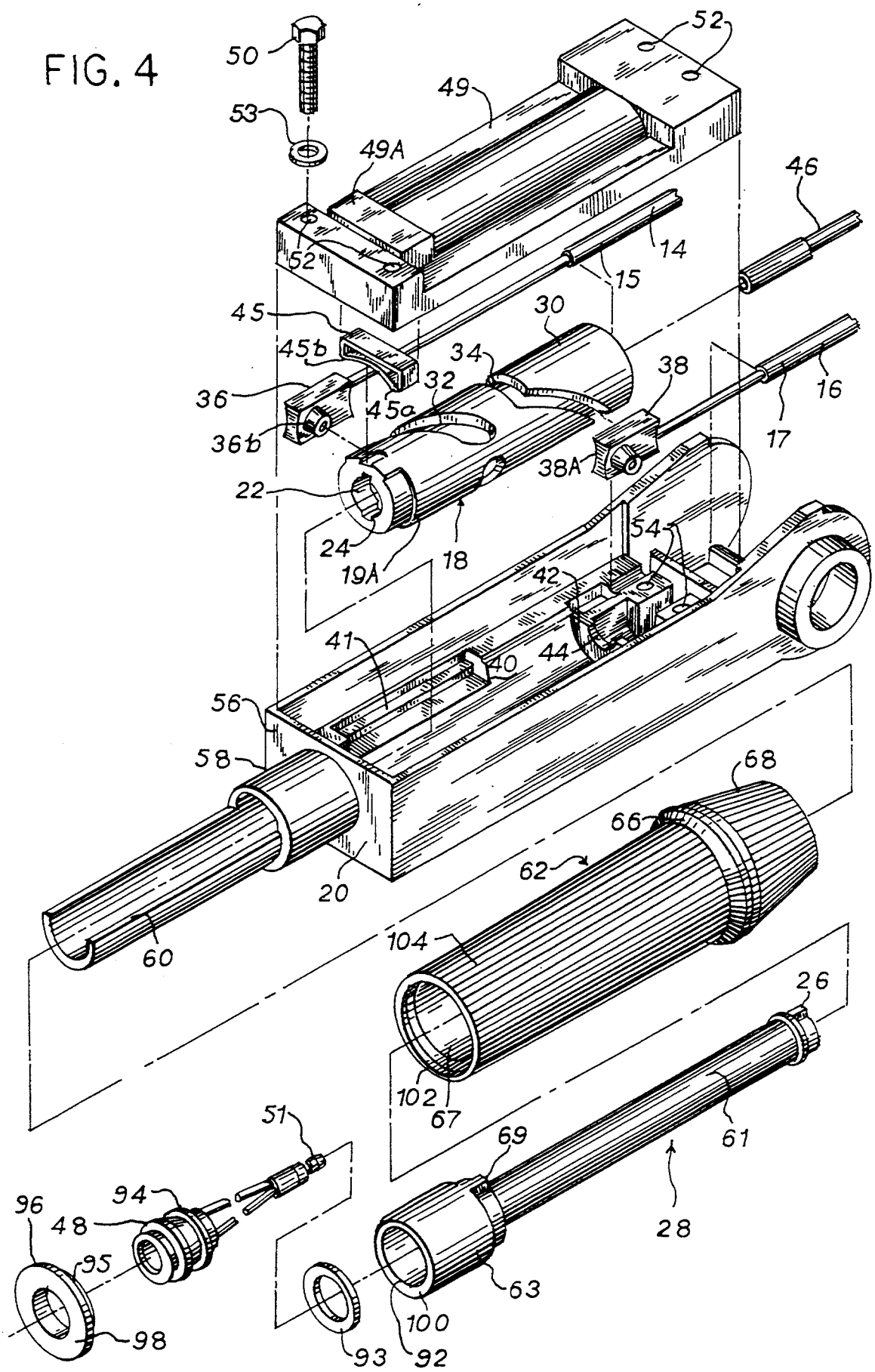
FIG. 4 is an exploded isometric view of the tiller handle of the invention.
Figure 6:
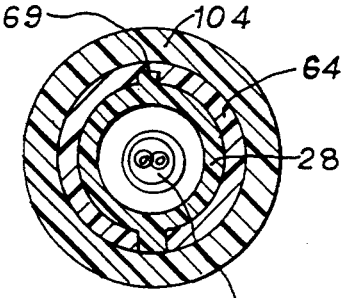
FIG. 6 is a sectional view of the tiller handle of the invention taken along line 6—6 of FIG. 2.

In the depicted embodiment, the tiller handle 12 is designed for use with a pair of push-pull cables 14 and 16, FIG. 4, to control the throttle and the shift operations of outboard marine propulsion system 10. Cable 14 is innerconnected to the throttle control mechanism within outboard propulsion system 10. Cable 16 is innerconnected to the shift control mechanism within outboard propulsion system 10. Protective sleeves 15 and 17 surround push-pull cables 14 and 16, respectively.

Figure 2:
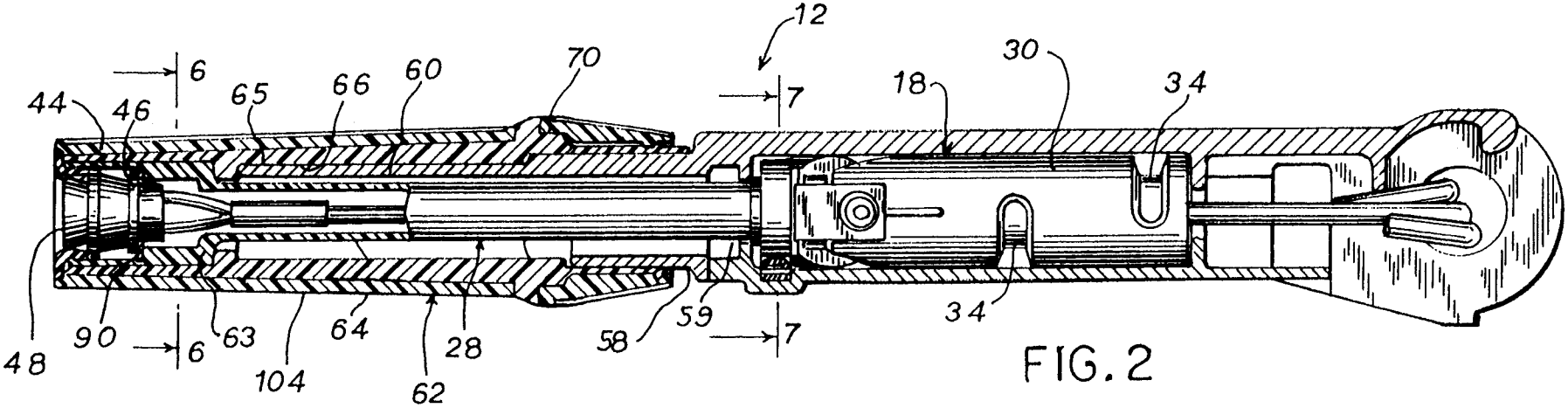
FIG. 2 is a longitudinal sectional view of the tiller handle of FIG. 1.
Figure 3:
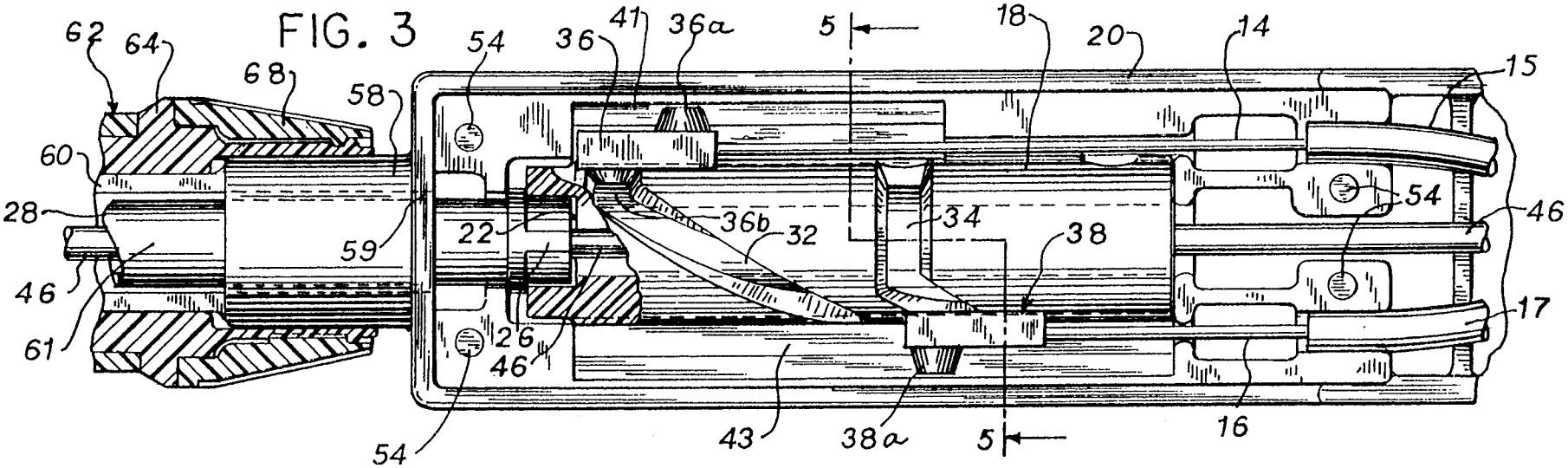
FIG. 3 is an enlarged partial sectional view, with portions broken away, showing a portion of the tiller handle of FIG. 2.

As shown in FIGS. 2 and 3, the tiller handle 12 includes a rotatable cam member 18 in a housing 20. Rotatable cam member 18 is generally cylindrical, defining a cavity 22 extending longitudinally therethrough. As shown in FIG. 4, an end 24 of cavity 22 is configured to receive a keyed end 26 of a drive tube 28. The rotatable cam member 18 is also provided with a pair of depressions **19*a* and 19*b* on the end of the surface of rotatable cam member 18**.

As shown in FIGS. 2–4, a pair of cam tracks 32 and 34 are formed on the outer surface 30 of rotatable cam member 18. In a manner to be explained, cam track 32 controls the throttle of outboard propulsion system 10 and cam track 34 controls the shift operation of system 10.

FIG. 8 illustrates the layout of cam tracks 32, 34 on the outer surface of cam member 18. Throttle cam track 32 is defined by a neutral throttle portion 31 positioned between a forward throttle portion 33 and a reverse throttle portion 35. Shift cam track 34 is defined by neutral shift track portion 37 interposed between a reverse shift track portion 39 and a forward shift track portion 47. The intersection of neutral throttle portion 31 and forward throttle portion 33 is generally aligned longitudinally with the center of reverse shift track portion 39. The intersection of neutral throttle portion 31 and reverse throttle portion 35 is generally aligned longitudinally with the center of forward shift track portion 47.

Bearings 36 and 38, FIGS. 3 and 4, are provided on one end of each push-pull cable 14 and 16, respectively. Each of bearings 36, 38 is provided with a pair of pin members 36*a*, 36*b*, and 38*a*, 38*b*, respectively, extending in opposite directions from the bearings 36 and 38. Pins 36*b* and 38*b* engage tracks 32 and 34 in a slidable relationship. Pin 36*a* of bearing 36 engages an axial channel 41, FIGS. 3, 4 and 9–11, in housing 20. Pin 38*a* of bearing 38 engages an axial channel 43 in housing 20.

The rotatable cam member 18 is placed in a chamber 40, FIG. 4, within housing 20. A partition 42 is molded within housing 20 to prevent longitudinal axial movement of rotatable cam member 18. A notch 44 in partition 42 allows a cable 46 to pass through cam member cavity 22 to interconnect the cable 46 to an engine kill switch 48 located at the end of a hand grip 62.

A cover 49 is placed over rotatable cam member 18 in order to secure the rotatable cam member 18 within housing 20. A square carriage 49*a* is provided in the cover 49 for carrying a detent spring 45. The cover 49 is affixed to the housing 20 by means of bolt 50 and washer 53 combinations. Each bolt 50 extends through an aperture 52 and is threaded into receipts 54 located in housing 20.

Figure 7:
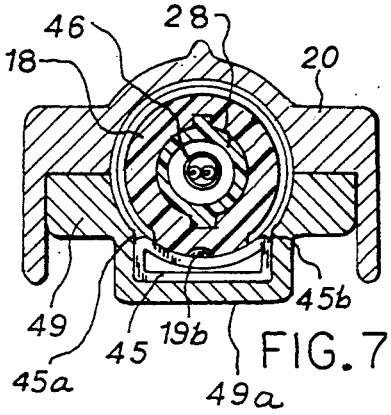
FIG. 7 is a sectional view of the tiller handle of the invention taken along line 7—7 of FIG. 2.

With cover 49 affixed to housing 20, detent spring 45 is biased against rotatable cam member 18 such that the ends 45*a* and 45*b* , FIG. 7, of detent spring 45 engage depression 19*a* on rotatable cam member 18. Upon turning rotatable cam member 18 clockwise, end 45*b* of detent spring 45 will engage depression 19*b* of rotatable cam member 18. If rotatable cam member 18 is turned counter-clockwise, end 45*a* will engage depression 19*b* on rotatable cam member 18.

Extending from a first end 56 of the housing 20 is a hollow cylindrical neck 58, FIG. 4, and a coaxial semi-cylindrical portion 60 extending from the neck 58. A passage 59, FIG. 2, is provided between the interior of the housing 20 and the interior of hollow neck 58. Handgrip 62 is placed coaxially over the semi-cylindrical portion 60 and the neck 58. The hand grip 62 is comprised of a hollow, generally cylindrical handle member 64, FIG. 2, provided for receipt of drive tube 28. An annular ring 65 extends along an inner wall 66 of a drive tube cavity 67 defined by cylindrical handle member 64. Two notches (not pictured) are provided on opposing sides of annular ring 65.

Drive tube 28 is comprised of a hollow cylindrical tube 61, FIG. 4, having a first keyed end 26 configured to form a mating relationship with end 24 of rotatable cam member 18. The second end of drive tube 28 is provided with an enlarged cylindrical sleeve 63 having tabs 69 extending axially inward toward keyed end 26. The tabs 69 are configured for engagement of the notches in annular ring 65. Enlarged cylindrical sleeve 63 of drive tube 28 has an annular ledge 90, FIG. 2, extending about its inner surface. A lip 92, FIG. 4, extends along the outer edge of the sleeve 63.

Figure 12:
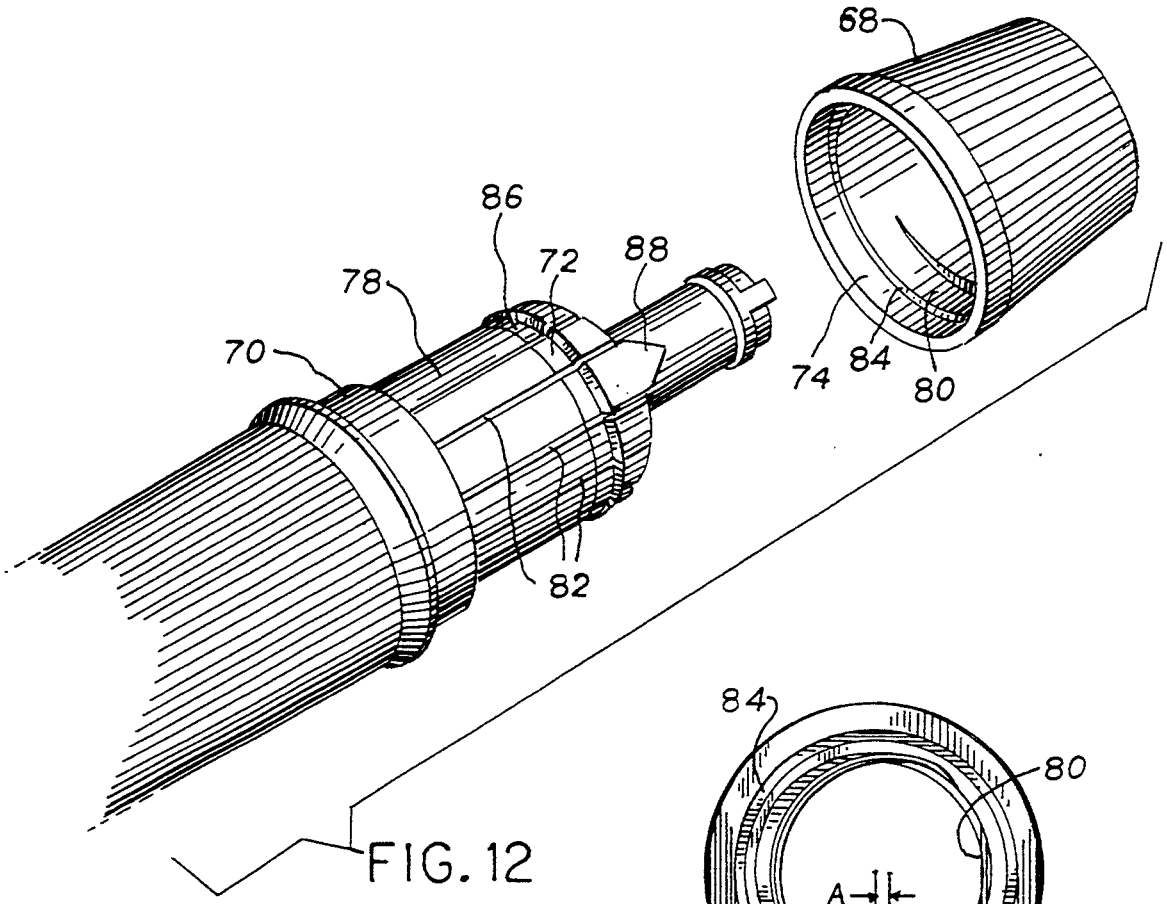
FIG. 12 is a partially exploded isometric view showing a friction control knob which forms a part of the tiller handle of the invention.
Figure 14:
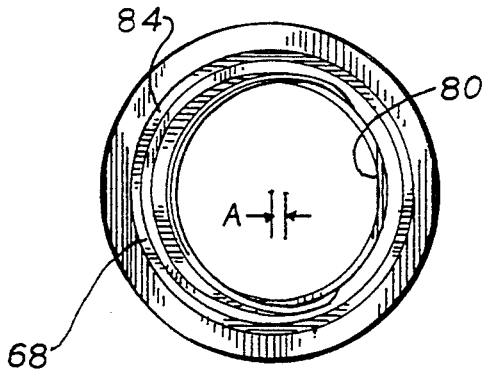
FIG. 14 is an end view of the friction control knob of FIGS. 12 and 13.
Figure 13:
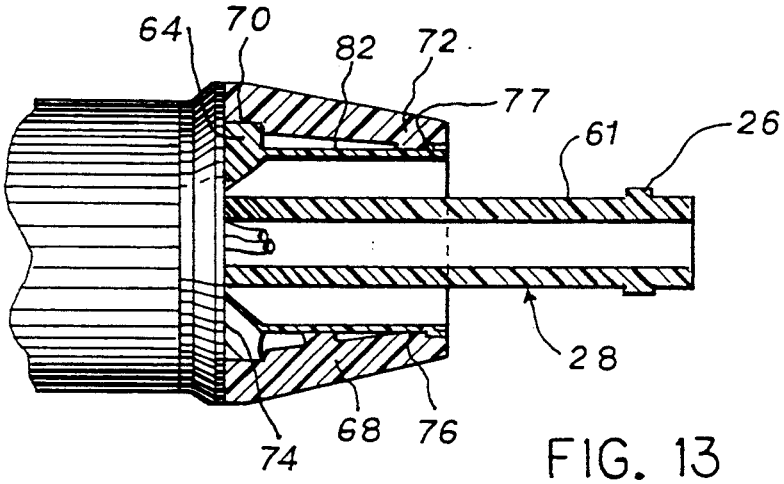
FIG. 13 is a partial side elevation view, with portions in section, showing the assembled friction control knob of FIG. 12.

A friction control knob 68, FIGS. 3 and 4, allows for the adjustment of the frictional force between the hand grip 62 and the housing 20 in response to rotation of the friction control knob 68 relative to the hand grip 62. As shown in FIGS. 12–14, the friction control knob 68 has the shape of a collar and is journaled on two circular bearing surfaces 70 and 72 formed on the cylindrical handle member 64 concentric with drive tube 28. The two bearing surfaces 70 and 72 on the cylindrical handle member 64 engage two circular concentric bearing surfaces 74 and 76 inside the friction control knob 68. A lip 77 is located adjacent bearing surface 72. An external circular cam surface 78 is formed on the cylindrical handle member 64 between bearing surfaces 70 and 72. An internal cam surface 80 is formed inside the friction control knob 68 between concentric bearing surfaces 74 and 76 to engage the external cam surface 78. The internal cam surface 80 is circular, with its center displaced from the axis of the drive tube by a distance A, as most clearly shown in FIG. 14.

Axial slots 82 are formed in the inner end of cylindrical handle member 64 through the cam surface 78 to allow the cammed portion of the cylindrical handle member 64 to be more readily compressed. An annular ridge 84 formed inside the friction control knob 68 engages a groove 86 which receives the bearing surface 72 on the cylindrical handle member 64. Friction control knob 68 can thus be snapped into place over the inner end of the cylindrical handle member 64 and held in place by engagement of control knob bearing surface 72 with lip 77.

A pointer 88, FIG. 12, is formed on the inside end of cylindrical handle member 64 to extend through the friction control knob 68.

The friction to resist rotation of the cylindrical handle member 64 can be adjusted by merely rotating the friction control knob 68 relative to the cylindrical handle member 64. As the knob 68 is rotated, the eccentric cam surface 80 in the knob 68 will press against the corresponding cam surface 78 on the cylindrical handle member 64, thus compressing a portion of the cylindrical handle member 64 against neck 58, FIG. 3. The device can be adjusted to create excessive friction. Since the friction control knob 68 rotates about the axis of the drive tube 28, the circular external configuration of the grip 62 will not be changed by rotating the friction control knob 68.

With hand grip 62 placed about neck 58, drive tube 28 is inserted within cylindrical handle member 64. Drive tube 28 is slid through passage 59, FIG. 2, between housing 20 and the neck 58 such that keyed end 26 of drive tube 28 engages end 24 of the rotatable cam member 18 in a mating relationship and tabs 69 engage the notches of annular ring 65. After drive tube 28 is placed in position within cylindrical handle member 64, a connection 51, FIG. 4, is interconnected to cable 46 and the kill switch 48 is slid axially into sleeve 63 such that an annular ring 94 on kill switch 48 compresses an annular ring 93 against an annular ledge 90 of the sleeve 63. An annular portion 95 of an end cap 96 is snap fitted onto lip 92 of sleeve 63 such that the face 98 of the end cap 96 is flush with the outer edge 100 of sleeve 63 and edge 102 of hand grip 62. A thermoplastic sleeve 104 is molded over the cylindrical handle member 64 to form a comfortable grip for the operator of the throttle handle 12.

In operation, tiller handle 12 is pivotally mounted in a conventional manner to the outboard marine propulsion system 10 as shown in FIG. 1. Push-pull cables 4 and 16 are interconnected to the throttle mechanism and the shift mechanism, respectively, of the marine engine 10. The throttle and the shift operations of the engine are controlled by simply rotating the hand grip 62 in either a clockwise or a counter clockwise direction.

The rotation of hand grip 62 in turn rotates drive tube 28. As described above, keyed end 26 of the drive tube 28 is engaged to the end 24 of rotatable cam member 18. As a result, rotation of hand grip 62 in turn causes rotation of the rotatable cam member 18 about the longitudinal axis of drive tube 28.

Figure 9:
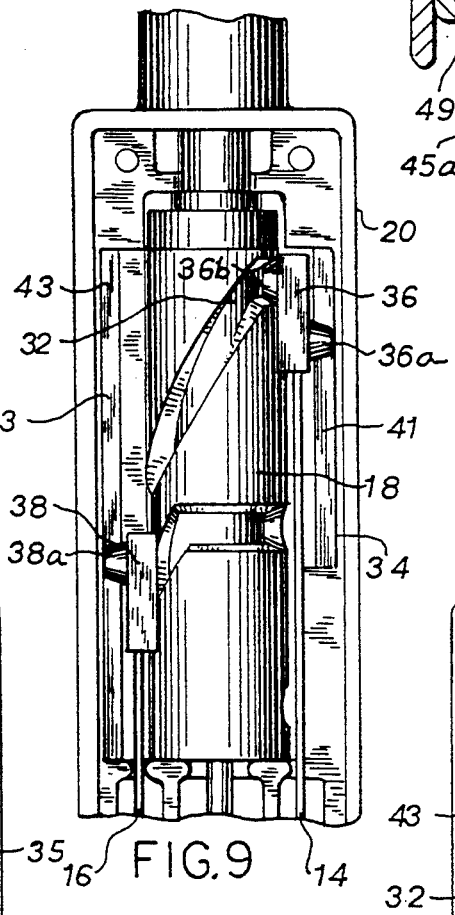
FIG. 9 is a partial sectional view similar to FIG. 3, showing the position of the cam with the marine engine in neutral gear.

FIG. 9 shows the position of bearings 36 and 38 with respect to channels 41 and 43 when the outboard marine engine is in neutral.

Bearing 36 innerconnected to push-pull cable 14 rides in cam track 32 on pin **36*b*. When the engine is in neutral, pin 36*b* of bearing 36 is located within neutral throttle portion 31 of cam track 32. Similarly, pin 38*b* on bearing 38 is located within the neutral shift track portion 37 of cam track 34**.

By rotating member 18, cam tracks 32 and 34 slide along pins **36*b*, 38*b* thereby axially moving pins 36*a*, 38*a* of bearings 36 and 38 along channels 41 and 43, respectively. The axial movement of bearings 36 and 38 actuates push-pull cables 14 and 16 thereby controlling the throttle and the shift mechanisms of the outboard marine propulsion system 10. Cam tracks 32 and 34 and the throttle and the shift mechanisms are coordinated with the propulsion system 10 such that the propulsion system 10 is shifted into forward gear before the forward throttle is applied. Likewise, the propulsion system 10** is shifted into reverse gear before application of the reverse throttle.

Figure 10:
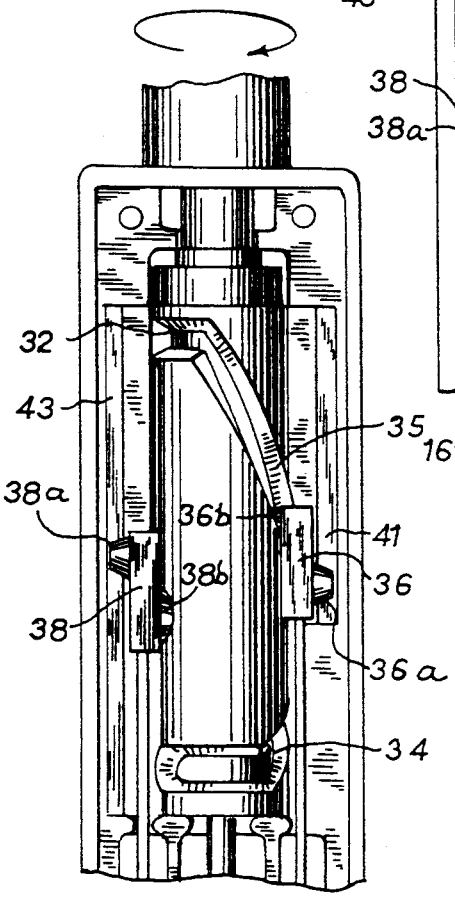
FIG. 10 is a partial sectional view similar to FIG. 9, showing the position of the cam with the marine engine in forward gear.

When the operator wishes to shift the propulsion system 10 into reverse, hand grip 62 is rotated in a clockwise manner, FIG. 10, thereby causing rotatable cam member 18 to rotate. By rotating rotatable cam member 18 and hence the cam tracks 32 and 34, bearings 36 and 38 slide axially along channels 41 and 43 respectively. Pin **38*b* of bearing 38 will slide into the reverse shift track portion 39 of cam track 34 and pin 38*a* of bearing 38 will slide axially in channel 43 so as to actuate the shift mechanism of the propulsion system 10 and shift the propulsion system 10 into reverse gear. When the propulsion system 10 is shifted into reverse gear, end 45*b* of detent spring 45 will engage depression 19*b* of rotatable cam member 18 so as to give the operator a feel for the shift. The cam tracks 32 and 34 are configured such that by continuing to turn hand grip 62 in a clockwise direction, pin 36*b* of bearing 36 will slide along reverse throttle portion 35 causing pin 36*a* of bearing 36 to slide axially along channel 41 thereby actuating the throttle mechanism of engine 10 and increasing the reverse throttle. FIG. 10 shows the position of bearings 36 and 38 with respect to channels 41 and 43, respectively, when propulsion system engine 10** is at full reverse throttle.

Figure 11:
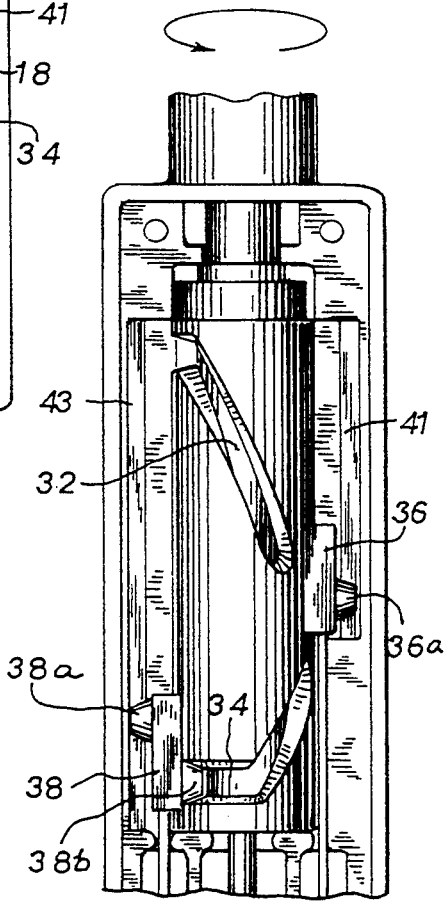
FIG. 11 is a partial sectional view similar to FIG. 9, showing the position of the cam with the marine engine in reverse gear.

In order to shift marine propulsion system 10 into forward, hand grip 62 is rotated counter clockwise, FIG. 11. Rotation of hand grip 62 causes pin **38*b* of bearing 38 to slide along cam track 34 into the forward shift track portion 47 resulting in pin 38*a* of bearing 38 sliding axially along channel 43. This shifts the propulsion system engine into forward gear. Upon shifting the propulsion system into forward gear, end 45*a* of detent spring 45 engages depression 19*b* of rotatable cam member 18 to give the operator a feel for the shift. Bearing 36 in turn slides along cam track 32 toward the forward throttle portion 33 of the cam track 32 and slides axially along channel 41 thereby actuating the forward throttle mechanism of the marine engine 10. FIG. 11 shows the position of bearings 36 and 38** when the marine engine in full forward throttle.

It is within the scope of this invention to design the tiller handle to control additional operations by the use of additional cam tracks and push-pull cables and coordinating their operation to other motor operations.

It can be seen through the description of this invention that various embodiments are possible without deviating from the scope and spirit of this invention.

We claim:

1. A tiller handle for use with a plurality of push-pull cables interconnected to the shift and the throttle mechanisms of an outboard marine propulsion system having an engine, to control the shift and the throttle operations of the engine, comprising:

a rotatable member secured within the tiller handle, the member having an inner surface and an outer surface;

a plurality of cam tracks located on the outer surface of the rotatable member, including at least a first throttle cam track and a second shift cam track;

means for maintaining each push-pull cable in a slidable relation with one of the cam tracks such that rotating the rotatable member results in rotational movement of the cam tracks and axial movement of the push-pull cables thereby controlling the operation of the shift mechanism and the throttle mechanism of the engine.

2. The device of claim 1 wherein a first push-pull cable innerconnects the shift cam track and the shift mechanism of the engine.

3. The device of claim 2 wherein the shift cam track is defined by a neutral shift portion interposed between a forward shift portion and a reverse shift portion.

4. The device of claim 1 wherein a second push-pull cable innerconnects the throttle cam track and the throttle mechanism of the engine.

5. The device of claim 4 wherein the throttle cam track is defined by a neutral throttle portion inter-posed between a forward throttle portion and a reverse throttle portion.

6. The device of claim 1 wherein the tiller handle further comprises a housing having a first end and a second end, wherein the second end is pivotally mounted to the outboard marine propulsion system.

7. The device of claim 6 wherein the rotatable member is secured within the housing.

8. The device of claim 6 further comprising means for rotating the rotatable member.

9. The device of claim 8 wherein the means for rotating the rotatable member comprises a drive tube extending through the first end of the housing and interconnected to the rotatable member such that rotation of the drive tube in turn rotates the rotatable member.

10. The device of claim 9 further comprising a shift and throttle portion of the tiller handle, the shift and throttle portion interconnected to the drive tube such that rotation of the shift and throttle portion rotates the drive tube in unison with the shift and throttle control portion.

11. The device of claim 10 further comprising means for limiting the rotation of the rotatable member.

12. The device of claim 11 wherein the means for limiting the rotation of the rotatable member includes means for creating frictional force between the shift and throttle control portion of the tiller handle and the housing such that the shift and throttle control portion cannot be rotated relative to the housing.

13. A tiller handle for use with a plurality of push-pull cables to control the shift and the throttle operations of an outboard marine engine comprising:

a housing having a first end and a second end, the second end being pivotally mounted to the outboard marine engine;

a tubular member rotatably mounted within the housing, the tubular member having an outer surface;

a cam cover secured to the housing to maintain the tubular member within the housing;

a plurality of cam tracks located on the outer surface of the tubular member;

means for rotating the tubular member;

means for maintaining each push-pull cable in a slidable relation with one of the cam tracks such that rotation of the tubular member actuates the push-pull cables thereby controlling the shift and the throttle operations of the outboard marine engine.

14. The device of claim 13 wherein the plurality of cam tracks includes at least a first throttle cam track having a neutral throttle portion interposed between a forward throttle portion and a reverse throttle portion and a shift cam track having a neutral shift portion interposed between a forward shift portion and a reverse shift portion.

15. The tiller handle of claim 13 wherein the means for rotating the tubular member is further comprised of a drive tube interconnected to the tubular member, the drive tube extending through the first end of the housing such that rotation of the drive tube in turn rotates the tubular member.

16. The device of claim 13 further comprising means for limiting the rotation of the drive tube.

17. A tiller handle for use with a plurality of push-pull cables to control the shift and the throttle operations of an outboard marine engine comprising:

a plurality of cam tracks located on the outer surface of the cam; and means for maintaining each of the push-pull cables in a slidable relation with a distinct cam track such that rotation of the cam actuates the push-pull cables.

18. The device of claim 17 further comprising a housing for receipt of the cam, and a cam cover for maintaining the cam within the housing.

19. The device of claim 18 further comprising means for rotating the cam.

20. The device of claim 19 wherein the means for rotating the cam is comprised of a rotatable drive tube extending through the housing, the tube having a first end complimentary to the first end of the cam such that the first end of the drive tube may be coupled with the first end of the cam in a mating relationship.

21. The device of claim 17 wherein the means for maintaining each push-pull cable in a slidable relation within a distinct cam track is comprised of a bearing on the end of each of the push-pull cables, each bearing engaging a distinct cam track in a slidable relationship.

22. The device of claim 17 further comprising means for preventing the unlimited rotation of the drive tube.

23. A tiller handle for use with a plurality of push-pull cables interconnected to the shift and the throttle mechanisms of an outboard marine propulsion system having an engine, wherein rotation of the tiller handle generates axial movement of the push-pull cables in order to control the shift and the throttle operations of the engine, comprising:

an outer member and an inner member wherein one of the members is stationary and the other member is rotatable with respect to the stationary member in response to rotation of the tiller handle;

a plurality of cam tracks on a surface of the inner member;

a plurality of channels located on a surface of the outer member; and means for maintaining each push-pull cable in a slidable relation with one of the cam tracks on the surface of the inner member and with one of the channels on the surface of the outer member such that rotation of one of the members in response to rotation of the tiller handle results in axial movement of the push-pull cables thereby controlling the operation of the shift mechanism and the throttle mechanism of the engine.

24. The device of claim 23 wherein the inner member is rotatable and the outer member is stationary.

25. The device of claim 24 wherein the inner member has an inner surface and an outer surface and wherein the plurality of cam tracks are located on the outer surface of the inner member, the cam tracks including at least a first throttle cam track and a second shift cam track.

26. The device of claim 25 wherein the shift cam track is defined by a neutral shift portion interposed between a forward shift portion and a reverse shift portion.

27. The device of claim 26 wherein the throttle cam track is defined by a neutral throttle portion interposed between a forward throttle portion and a reverse throttle portion.

* * * * *

UNITED STATES PATENT AND TRADEMARK OFFICE

CERTIFICATE OF CORRECTION

PATENT NO. : 5,340,342

DATED : August 23, 1994

INVENTOR(S) : JAMES C. BODA ET AL

It is certified that error appears in the above-identified patent and that said Letters Patent is hereby corrected as shown below:

CLAIM 2, Col. 6, Line 40, delete "innerconnects" and substitute therefor -- interconnects --; CLAIM 4, Col. 6, Line 46, delete "innerconnects" and substitute therefor -- interconnects --; Col. 6, line 49 CLAIM 5, delete "inter-posed" and substitute therefor -- interposed --; CLAIM 17, Col. 7, Line 48, after "comprising:" add the following paragraph -- a cam having an outer surface and first and second ends; --;

Signed and Sealed this

Twenty-ninth Day of November, 1994

*Attest:*

Bruce Lehman

BRUCE LEHMAN

*Attesting Officer*

*Commissioner of Patents and Trademarks*